United States Patent [19]

Westgor

[11] Patent Number: 4,738,545

[45] Date of Patent: Apr. 19, 1988

[54] COMBINED MAT AND CARRYING BAG UNIT

[76] Inventor: Marta Westgor, 323 - 6th St., Windom, Minn. 56101

[21] Appl. No.: 518,922

[22] Filed: Aug. 1, 1983

[51] Int. Cl.[4] ..... A45C 9/00; A45C 3/12; A45C 13/10

[52] U.S. Cl. ..... 383/4; 383/75; 190/1; 190/2; 5/417; 5/420

[58] Field of Search ..... 383/4, 7, 71, 75, 76; 190/1, 2, 8; 5/417, 420

[56] References Cited

U.S. PATENT DOCUMENTS

| | | | |
|---|---|---|---|
| 2,479,203 | 8/1949 | Brown | 383/4 |
| 2,626,648 | 1/1953 | Anderson | 383/4 |
| 2,766,797 | 10/1966 | Cowen | 383/4 X |
| 3,337,812 | 7/1982 | Trinkner | 383/4 |
| 3,489,194 | 1/1970 | Hoover | 190/1 X |

*Primary Examiner*—William Price

*Assistant Examiner*—Sue A. Weaver

*Attorney, Agent, or Firm*—Kinney & Lange

[57] ABSTRACT

A combination mat and carry bag unit includes a sheet of pliable material defining a mat of size to accommodate a person thereon for use as an exercise mat, beach mat or the like. The sheet has a drawstring casing extending about its periphery. The casing has two openings therein on opposite sides of the mat and a drawstring is received in the drawstring casing and is of size to extend continuously about the periphery of the sheet when it defines a mat. The drawstring is slidably received in the drawstring casing so that when portions of the drawstring are pulled out of the drawstring casing through the two openings, the periphery of the sheet forms gathers adjacent the casing to permit the periphery to reduce in size whereby the unit forms a carrying bag. Those portions of the drawstring which are pulled out of the casing are secured together adjacent the openings to form a handle for the carrying bag.

14 Claims, 1 Drawing Sheet

10
28
14
50
44
32
26
12
16
24
34
40
30
50
42
2
2
33

22
10
16
24
36
33
34
12
18
20
38
50
40

32
54
58
50
44
33
10
16
50
12
24
64
26
28
50
33
30
52
42
50
56

70
66
42
52
34
44
50
60
54
10
18
62

COMBINED MAT AND CARRYING BAG UNIT

BACKGROUND OF THE INVENTION

1. Field of the Invention

The present invention relates to combination mat and carrying bag units.

2. Description of the Prior Art

Numerous attempts have been made to design devices which alternatively function as a utility bag or a beach mat. The prior devices in this field have been unnecessarily complex, however. The purpose of such devices is to provide a mat for use at the beach or for exercising which can be transformed into a carrying bag for articles which the user desires to transport, such as towels, suntan lotion, sun glasses, exercise clothes or the like. Examples of such devices include those shown in the following U.S. patents:

| U.S. Pat. No. | Patentee | Issue Date |
|---|---|---|
| D258,035 | Fenwick | 01/27/81 |
| 4,197,891 | Comollo | 04/15/80 |
| 4,164,275 | Davis | 08/14/79 |
| 3,976,113 | Kim | 08/24/76 |

The Fenwick patent is a design patent for beach blanket with storage pocket. For transport, the blanket is apparently folded or rolled with a pair of tie strings used to secure the blanket in a closed position. The Comollo patent discloses a device which is folded for transport. Handles protrude from this device, both when folded and when unfolded. The Davis patent shows a device in which a beach mat is rolled up for transport and which has a small drawstring arrangement at each end of the mat when rolled for securing the mat in its rolled position. Articles to be carried are apparently stuffed into the rolls of the device, and the device has handles for carrying it during transport. The device shown in the Kim patent employs a relatively complex arrangement of zippers to transform the device from a bag to a blanket. This device has detachable handles for use when it is formed as a tote bag.

All of these prior combination mat and carrying bag devices have handles or fastening means which necessarily form a part of the interior of the mat when the device is used as a mat. For example, the Kim device has zippers which cross the interior of the mat, the Comollo and Davis device have handles which lie in the interior of the mat and the Fenwick device has a storage pocket and tie strings which impinge upon the interior of the mat when laid out for use at the beach or exercise. The means for changing these devices from mats into a carrying bags (and vice versa) are also unnecessarily cumbersome. Additionally, much of the potential volume of the carrying bags of these devices is lost due to the manner in which the mat is transformed into a carrying bag.

The combination mat and carrying bag unit of the present invention overcomes all of the stated disadvantages of the prior art. The present invention is quite simple, has no handles or other portions which impinge upon the interior of the unit when it defines a mat, is easy to change from a mat to a bag or vice versa and, by design, maximizes the potential volume of the carrying bag.

SUMMARY OF THE INVENTION

The present invention comprises a combination mat and carrying bag unit which includes a sheet of pliable material of size to define a mat to accommodate a person thereon. A drawstring casing extends about the periphery of the sheet and has a plurality of openings therein. A drawstring is received in the drawstring casing and is of size to extend about the periphery of the sheet when it defines a mat. The drawstring is slidably received in the drawstring casing so that when portions of the drawstring are pulled out of the drawstring casing through the openings, the periphery of the sheet forms gathers adjacent the casing to permit the periphery to reduce in size and form a carrying bag.

Preferably, the sheet has a generally rectangular periphery defined by two generally parallel side edges and two generally parallel end edges, the side edges being longer than and generally perpendicular to the end edges. The drawstring casing has two openings positioned proximate the midpoints of those portions of the casing which extend along the end edges. When portions of the drawstring are pulled out of the two openings and such drawstring portions are secured together adjacent the openings, a handle portion is formed. The handle portion is comprised of the drawstring casing, those portions of the sheet adjacent the drawstring casing and those portions of the drawstring pulled out of the two openings. The sheet of pliable material preferably comprises a first generally rectangular sheet of fabric, a second generally rectangular sheet of fabric and a generally rectangular layer of resilient cushioning material secured between the first and second sheets. When the unit defines a carrying bag, the first sheet forms an interior surface of the carrying bag and the second sheet forms an exterior surface of the carrying bag.

BRIEF DESCRIPTION OF THE DRAWINGS

FIG. 1 is a perspective view of a combination mat and carrying bag unit of the present invention as it defines a mat for exercise use or the like.

DETAILED DESCRIPTION OF THE PREFERRED EMBODIMENTS

Figure 1:
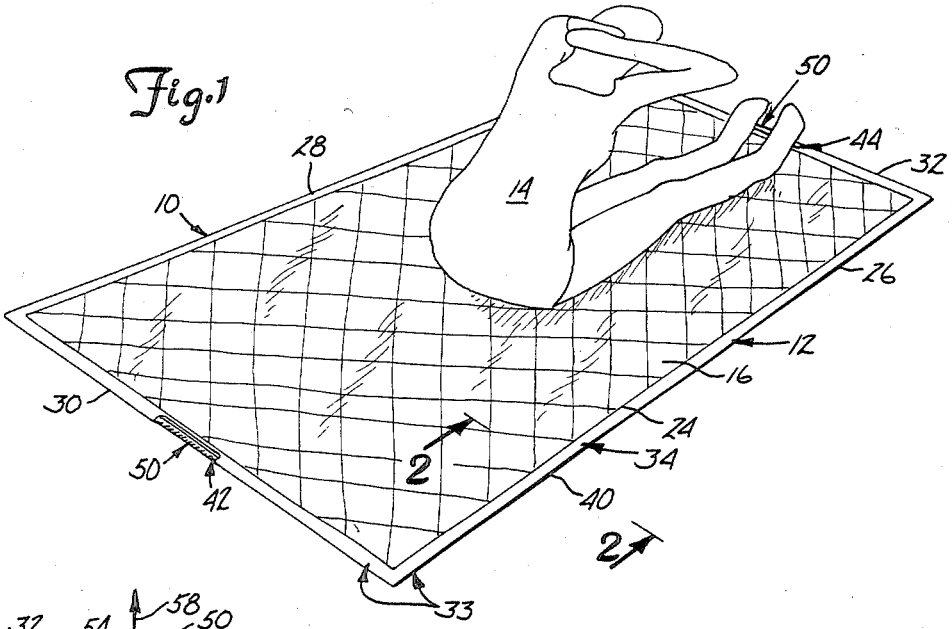
Figure 2:
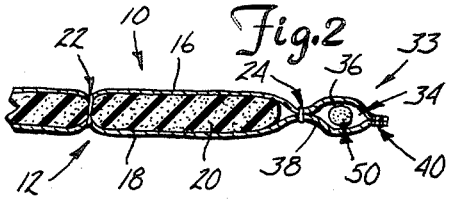
FIG. 2 is a partial sectional view as taken along lines 2—2 in FIG. 1.

A combination mat and carrying bag unit 10 of the present invention is shown in use as a mat 12 in FIG. 1. The mat 12 is of size to accommodate a person 14 thereon and is suitable for use as an exercise mat, beach mat or the like. As shown in FIG. 2, the unit 10 is preferably comprised of a first sheet of pliable fabric 16, a second sheet of pliable fabric 18 and a layer of resilient cushioning material 20 which is secured between the first and second sheets 16 and 18. First and second sheets of pliable fabric 16 and 18 preferably each comprise a layer of woven material, which is soft and pliable enough to be comfortable against the skin of a person 14 using the mat, but durable enough to withstand frequent use and washings. The layer of cushioning material 20 is typically foam, and is held generally in place between the first and second sheets 16 and 18 by stitching or quilting the sheets and cushioning material together as illustrated at 22 in FIG. 2.

Preferably, the first and second sheets 16 and 18 and the layer of resilient cushioning material 20 are generally rectangular in shape so as to define a uniformly and fully cushioned mat 12, as shown in FIG. 1. As best shown in FIG. 2, the first and second sheets 16 and 18 are secured together about their edges (as at 24 in FIG. 2) so that the layer of cushioning material 20 is fully encased by the first and second sheets 16 and 18. The first sheet 16, second sheet 18 and layer of cushioning material 20 thus combine to form a mat 12 having a generally rectangular periphery. The periphery of the mat 12 is defined by two generally parallel side edges 26 and 28 and two generally parallel end edges 30 and 32, with the side edges 26 and 28 being longer than and generally perpendicular to the end edges 30 and 32.

As illustrated in FIG. 2, a hem 33 extends about the entire periphery of the mat 12 to define a drawstring casing or passageway 34. Preferably, the drawstring casing 34 is formed by outer portions 36 and 38 of the first and second sheets 16 and 18 respectively. Preferably the outer edge portions 36 and 38 are secured together adjacent the periphery of the layer of resilient cushioning material 20 as at 24 and are sewed together by stitching means as at 40 as illustrated in FIG. 2. With the outer edge portions 36 and 38 of the first and second sheets 16 and 18 thus so secured, the drawstring casing 34 or passageway is formed there-between. Preferably, the outer edge portions 36 and 38 of the first and second sheet 16 and 18 are secured in this manner completely about the peripheries of the sheets 16 and 18, thus creating a drawstring casing 34 extending about the entire periphery of the mat 12.

The hem 33 has a first opening 42 and a second opening 44 therein, with each opening communicating with the passageway or drawstring casing 34. The openings 42 and 44 extend through that part of the outer edge portions 36 and 38 which would be otherwise fastened as at 40. The first opening 42 is positioned proximate the midpoint of the end edge 30 of the mat 12 and the second opening 44 is positioned proximate the midpoint of the end edge 32 of the mat 12. The first and second openings 42 and 44 are thus on opposite ends of the mat 12.

Figure 3:
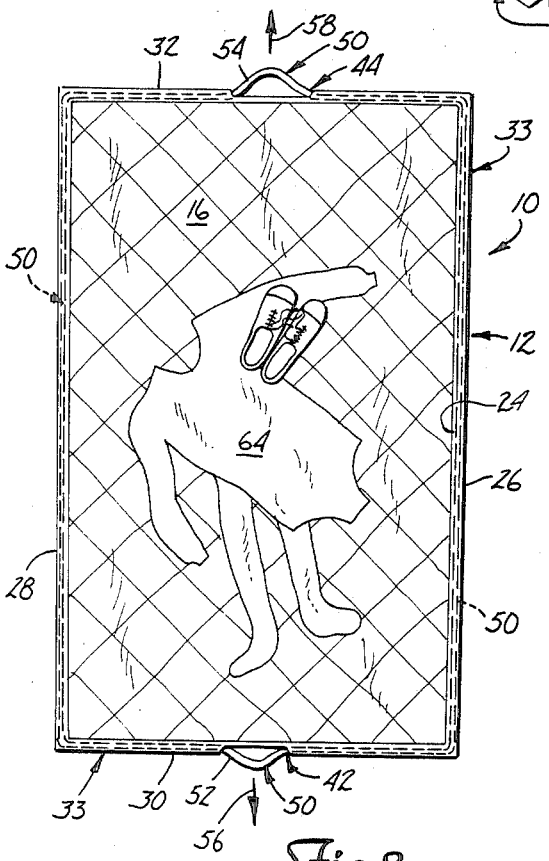
FIG. 3 is a top plan view of the combination mat and carrying bag unit as it defines a mat.

A cord or drawstring 50 is received in the drawstring casing 34 and is of size to extend about the periphery of the unit 10 when it defines a mat 12 as illustrated in FIGS. 1 and 3. The drawstring 50 is slidably received in the drawstring casing 34 so that its movement within the drawstring casing 34 about the periphery of mat 12 is unrestricted. Preferably, the drawstring 50 is endless, with a first portion 52 of the drawstring 50 extending past the first opening 42 of the casing 34 and a second portion 54 of the drawstring 50 extending past the second opening 44 of the casing 34. The first and second portions 52 and 54 are thus always accessible through their respective openings 42 and 44.

To change the configuration of the unit 10 form a mat to a carrying bag, the first and second portions 52 and 54 of the drawstring 50 are pulled out of the drawstring casing 34 through their respective openings 42 and 44. The drawstring portions 52 and 54 are pulled in direction out of and away from the drawstring casing 34 generally as indicated by arrows 56 and 58, respectively, in FIG. 3.

As the first and second drawstring portions 52 and 54 are pulled out of the openings 42 and 44, the drawstring casing 34, first sheet 16, second sheet 18 and layer of cushioning material 20 form gathers 60 adjacent the periphery of the unit 10 to permit the periphery thereof to reduce in size. The drawing together or contraction of the hem 33 and casing 34 causes the casing 34 to pucker or ruffle to form the gathers 60. The first and second sheets 16 and 18 and layer of resilient cushioning material 20 adjacent the casing 34 also pucker or contract together as the gathers 60 are formed.

Figure 4:
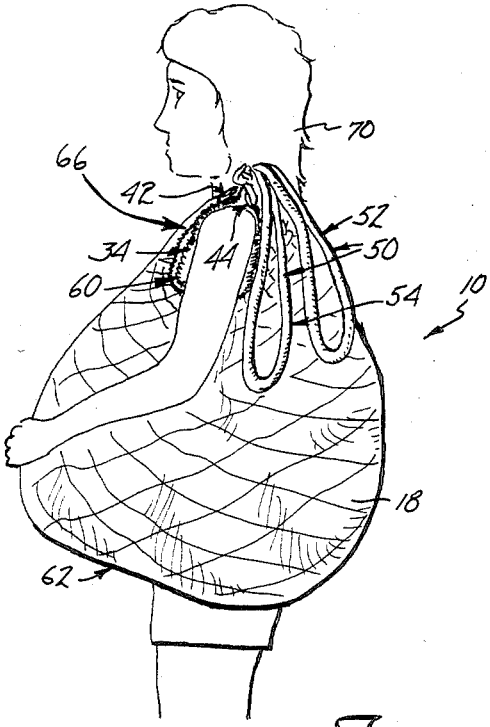
FIG. 4 is a perspective view of the combination mat and carrying bag unit as it defines a carrying bag.

As the periphery reduces in size and the gathers 60 are formed, the edges of the mat 12 are drawn together to cause the unit 10 to form a carrying bag 62. When the unit 10 defines a carrying bag 62 as illustrated in FIG. 4, the first sheet 16 forms an interior surface of the carrying bag 62 and the second sheet 18 forms an exterior surface of the carrying bag 62. When formed as a carrying bag 62 as shown in FIG. 3, a number of articles, such as exercise clothes or shoes (designated generally as at 64 in FIG. 2) can be carried within the carrying bag 62. The volume of the carrying bag 62 is dependent upon the size of the mat 12 defined by the unit 10. Because of the pliable nature of the materials comprising the carrying bag 62, it is a highly efficient carrier of materials, capable of defining its shape about the articles to be carried and having a large capacity or carrying volume relative to combination mat and carrying bag units of the prior art.

A handle portion 66 for the carrying bag 62 is created by securing the drawstring portions 52 and 54 together once they have been pulled out of their respective openings 42 and 44. Preferably, the drawstring portions 52 and 54 are secured together adjacent or proximate to their respective openings 42 and 44 as shown in FIG. 4. The drawstring portions 52 and 54 can be secured together by tying them together or by other suitable fastening means. When the handle portions 52 and 54 are secured together adjacent the openings 42 and 44, the handle portion 66 comprises portions of the sheet adjacent the drawstring casing 34 and portions of the drawstring 50. Preferably, the handle portion 66 is of size so that a person 70 can extend his or her arm through the handle portion 66 and sling the carrying bag 62 over his or her shoulder, as illustrated in FIG. 4.

When thus formed as a carrying bag 62, the combination mat and carrying bag unit 10 can be easily transported from place to place while carrying towels or other articles (such as articles 64). Because the carrying bag 62 has the layer of resilient cushioning material 20 between its exterior surface and interior surface, the articles carried therein are cushioned and protected from possible damage during transport. The pliable nature of the carrying bag 62 permits it to take the configuration of the articles being transported as well.

To change the configuration of the combination mat and carrying bag unit 10 from the carrying bag 62 into the mat 12, the drawstring portions 52 and 54 are unsecured or untied and the casing 34 is manipulated (by pulling out the pleats or gathers therein to permit those portions of the drawstring 50 (first and second portions 52 and 54) which are outside of the casing 34 to be slidably received therein. Once the drawstring 50 is fully received within the drawstring casing 34 so that it extends about the periphery of the mat 12 as illustrated in FIGS. 1 and 2, the unit 10 is again suitably configured for use as an exercise or beach mat (or blanket).

Although the present invention has been described with reference to preferred embodiments, workers skilled in the art will recognize that changes may be made in form and detail without departing from the spirit and scope of the invention.

| PARTS LIST | |
|---|---|
| 10 combination mat & carrying bag unit | 60 gathers |
| 12 mat | 62 carrying bag/ sachel |
| 14 person (on 12 in FIG. 1) | 64 articles to be carried in FIG. 2 |
| 16 first sheet of pliable fabric | 66 handle portion |
| 18 second sheet of pliable fabric | 68 |
| 20 layer of resilient cushioning mat'l (between 16 & 18) | 70 person |
| 22 stitching/quilting | 72 |
| 24 stitches about peripheries of 16 & 18 | 74 |
| 26 side edge (of periphery of 12) | 76 |
| 28 side edge (of periphery of 12) | 78 |
| 30 end edge (of periphery of 12) | 80 |
| 32 end edge (of periphery of 12) | 82 |
| 33 hem | 84 |
| 34 drawstring casing | 86 |
| 36 outer edge portion (of 16) | 88 |
| 38 outer edge portion (of 18) | 90 |
| 40 fastening of 36 & 38 | 92 |
| 42 opening (in 34) | 94 |
| 44 opening (in 34) | 96 |
| 46 | 98 |
| 48 | 100 |
| 50 endless drawstring | 102 |
| 52 first portion (of 50) | 104 |
| 54 second portion (of 50) | 106 |
| 56 directional arrow (for 52) | 108 |
| 58 directional arrow (for 54) | |

What is claimed is:

1. A combination mat and carrying bag unit comprising:

a sheet of pliable material defining a mat of size to accommodate a person thereon, the sheet having a drawstring casing extending about its periphery with the casing having two openings on opposite sides of the sheet, the sheet having a generally rectangular periphery defined by two generally parallel side edges and two generally parallel end edges, the side edges being longer than and generally perpendicular to the end edges, and the two openings in the drawstring casing being positioned proximate the midpoints of those portions of the casing which extend along the end edges; and an endless drawstring received in the drawstring casing and of size to extend about the generally rectangular periphery of the sheet when it defines a mat, and the drawstring being slidably received in the drawstring casing so that when portions of the drawstring are pulled out of the drawstring casing through the two openings, the periphery of the sheet forms gathers adjacent the casing to permit the periphery to reduce in size and to form a carrying bag, and when such drawstring portions are secured together adjacent to the openings a handle portion is formed which comprises portions of the sheet adjacent the drawstring casing.

2. The invention of claim 1 wherein the sheet of pliable material comprises a first layer of woven material, a second layer of woven material and a layer of resilient cushioning material secured between the first and second layers of woven material.

3. The invention of claim 1 wherein the sheet of pliable material has a generally rectangular periphery.

4. The invention of claim 1 wherein the handle portion is of size so that a person can extend his or her arm through the handle portion.

5. A combination mat and carrying bag unit comprising:

a sheet of pliable material with a generally rectangular periphery suitable for use as an exercise mat, beach mat or the like;

a hem about the generally rectangular periphery of the sheet forming passage-way means about the periphery, the hem having two openings therein on opposite sides of the sheet with each opening communicating with the passageway means; and cord means retained in the passageway means and of length to extend about the generally rectangular periphery of the sheet, portions of the cord means being slidably received in the passageway means adjacent the openings so that when portions of the cord means are pulled out of the passageway means through the openings and secured together adjacent the openings, the sheet gathers adjacent the hem to define a carrying bag with portions of the sheet adjacent to each of the openings in the hem forming a handle portion.

6. The invention of claim 5 wherein the sheet of pliable material comprises a first layer of woven material, a second layer of woven material and an layer of resilient cushioning material secured between the first and second layers of woven material.

7. The invention of claim 6 wherein when the unit defines a carrying bag, the first layer of woven material forms an interior surface of the carrying bag and the second layer of woven material forms an exterior surface of the carrying bag.

8. The invention of claim 5 wherein the sheet has a generally rectangular periphery defined by two generally parallel side edges and two generally parallel end edges, the side edges being longer than and generally perpendicular to the end edges, and the two openings in the hem being positioned proximate the midpoints of those portions of the hem which extend along the end edges.

9. The invention of claim 5 wherein the handle portion is of size so that a person can extend his or her arm through the handle portion.

10. A combination mat and carrying bag unit comprising:

a first generally rectangular sheet of pliable fabric;

a second generally rectangular sheet of pliable fabric;

a generally rectangular layer of resilient cushioning material secured between the first and second sheets, with the first and second sheets being secured together about their edges so that the first sheet, second sheet and layer of cushioning material form a mat having a generally rectangular periphery;

a drawstring casing extending about the periphery of the mat, the casing having two openings therein an opposite sides of the periphery with each opening communicating with the casing; and a drawstring received in the drawstring casing and of size to extend about the periphery of the mat when a mat is formed, and the drawstring being slidably received in the casing so that when portions of the drawstring are pulled out of the casing through the openings the casing, first sheet, second sheet and layer of cushioning material form gathers adjacent the periphery to permit the periphery to reduce in size and cause the unit to define a carrying bag with portions of the first sheet, second sheet and layer of cushioning material adjacent to the casing forming a handle portion.

11. The invention of claim 10 wherein when the drawstring portions are pulled out of the two openings and secured together so that the two openings are positioned adjacently, a handle portion is formed by those portions of the first sheet, second sheet and layer of cushioning material adjacent the drawstring casing.

12. The invention of claim 10 wherein the generally rectangular periphery of the mat is defined by two generally parallel side edges and two generally parallel end edges, the side edges being longer than and generally perpendicular to the end edges, and the two openings in the drawstring casing being positioned proximate the midpoints of those portions of the casing which extend along the end edges.

13. The invention of claim 10 wherein when the unit defines a carrying bag, the first sheet of fabric forms an interior surface of the carrying bag and the second sheet of fabric forms an exterior surface of the carrying bag.

14. The invention of claim 10 wherein the handle portion is of size so that a person can extend his or her arm through the handle portion.

* * * * *

UNITED STATES PATENT AND TRADEMARK OFFICE

CERTIFICATE OF CORRECTION

PATENT NO. : 4,738,545

DATED : April 19, 1988

INVENTOR(S) : Marta Westgor

It is certified that error appears in the above-identified patent and that said Letters Patent is hereby corrected as shown below:

Column 7, line 16, after "therein", delete "an" and insert --on--.

Signed and Sealed this

Thirteenth Day of September, 1988

*Attest:*

DONALD J. QUIGG

*Attesting Officer*

*Commissioner of Patents and Trademarks*